US007207809B2

(12) United States Patent
Sasaki et al.

(10) Patent No.: US 7,207,809 B2
(45) Date of Patent: Apr. 24, 2007

(54) METHOD OF MANUFACTURING TERMINAL

(75) Inventors: Harehide Sasaki, Aichi-ken (JP); Reiki Okamoto, Aichi-ken (JP); Yoshiaki Kato, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 80 days.

(21) Appl. No.: 11/199,361

(22) Filed: Aug. 9, 2005

(65) Prior Publication Data

US 2006/0040568 A1 Feb. 23, 2006

(30) Foreign Application Priority Data

Aug. 19, 2004 (JP) ..... 2004-239990

(51) Int. Cl.
*H01R 12/00* (2006.01)

(52) U.S. Cl. ..... 439/79; 29/883

(58) Field of Classification Search ..... 439/79, 439/80, 883, 874; 29/883, 884, 858
See application file for complete search history.

(56) References Cited

U.S. PATENT DOCUMENTS

| | | | | |
|---|---|---|---|---|
| 6,505,402 | B2 * | 1/2003 | Moriwake et al. | 29/883 |
| 6,506,063 | B1 * | 1/2003 | Moriwake et al. | 439/79 |
| 7,086,873 | B2 * | 8/2006 | Nose et al. | 439/79 |
| 2002/0192988 | A1 * | 12/2002 | Droesbeke et al. | 439/79 |
| 2004/0115971 | A1 * | 6/2004 | Nose et al. | 439/79 |
| 2005/0208795 | A1 * | 9/2005 | Huang | 439/79 |

FOREIGN PATENT DOCUMENTS

| | | |
|---|---|---|
| JP | 2001-110491 | 4/2001 |
| JP | 2002-279685 | 9/2002 |
| JP | 2002-371236 | 12/2002 |

* cited by examiner

*Primary Examiner*—Phuong Dinh
(74) *Attorney, Agent, or Firm*—Roberts, Mlotkowski & Hobbes; Thomas W. Cole

(57) ABSTRACT

In a terminal manufacturing method of the present invention, first a thin plate-like body including a thin plate-like terminal portion and a thin plate-like leg portion is formed with a die. The thin plate-like terminal portion has a shape corresponding to a terminal portion 24 of an upper-level terminal 22 and a terminal portion 30 of a lower-level terminal 28. The thin plate-like leg portion has the shape corresponding to a leg portion 26 of the upper-level terminal 22 and a leg portion 32 of the lower-level terminal 28. Then, the upper-level terminal 22 is formed by bending the thin plate-like leg portion toward one side of a plate-thickness direction. Also, the lower-level terminal 28 is formed by bending the thin plate-like leg portion toward the other side of the plate-thickness direction. Thus, by simply changing the bending direction of the thin plate-like leg portion, either the upper-level terminal 22 or the lower-level terminal 28 can be formed. According to the terminal manufacturing method of the invention, when the terminal includes a first terminal mounted in an upper-level mounting hole of a connector housing and a second terminal mounted in a lower-level mounting hole, these two terminals can share a blank material of the same type in common at the manufacturing stage thereof.

19 Claims, 3 Drawing Sheets

METHOD OF MANUFACTURING TERMINAL

CROSS-REFERENCE TO RELATED APPLICATION

This application claims priority under 35 USC 119 from Japanese Patent Application No. 2004-239990, the disclosure of which is incorporated by reference herein.

BACKGROUND OF THE INVENTION

1. Field of the Invention

The present invention relates to a method of manufacturing a terminal, which terminal is applied to a connector housing constituting a connector and soldered to a board while projected from the connector housing when the terminal is attached to the connector housing.

2. Description of the Related Art

For example, a surface-mount connector (hereinafter also referred to as SMT connector) and the like are mounted on the board of an electronic device or an electronic circuit by soldering.

Some of the SMT connectors include a connector housing which is formed in a substantially rectangle box, a lower-level terminal (group of terminals), and an upper-level terminal (group of terminals) attached to a side face of the connector housing. The lower-level terminal and the upper-level terminal are inserted into two-level (upper and lower) mounting holes provided in the side face of the connector housing.

In the state in which the lower-level terminal and the upper-level terminal are attached into the mounting holes of the connector housing, the lower-level terminal and the upper-level terminal are projected outward from the side face of the connector housing and bent downward (toward the board side), with front-end portions of the lower-level terminal and the upper-level terminal being bent along an upper surface of the board. The front-end portion of the lower-level terminal is separated from the connector housing. The front-end portion of the upper-level terminal is also separated from the connector housing but positioned at the opposite side, with respect to the connector housing, to the front-end portion of the lower-level terminal.

A solder fillet is formed in a bending portion, on the base end side, of the front-end portion of each terminal, and a shape of the soldering fillet influences soldering strength. Further, in the above mounting state, it is necessary that a solder bridge is not generated between the terminals.

Therefore, whether or not the solder fillet is properly formed and whether or not each terminal is mounted while the solder bridge does not exist are confirmed by visual inspection or an inspection apparatus utilizing image processing and the like (appearance inspection).

However, in the SMT connector, the front-end portions of the upper-level terminal and the lower-level terminal are provided outward with respect to the connector housing, and the solder fillet is formed so as to be hidden in the back sides of the upper-level terminal and the lower-level terminal. Therefore, in the configuration in which the plural upper-level terminals and the plural lower-level terminals are provided in parallel, sometimes the appearance inspection is difficult to perform.

In particular, the solder fillet of the lower-level terminal, which is located closer to the connector housing than the upper-level terminal, is positioned so as to be hidden by the upper-level terminal, and the appearance inspection thereof is more difficult to perform than in the case of the solder fillet of the upper-level terminal. Further, if the appearance inspection of the solder fillet of the lower-level terminal can be performed, when formation of the solder bridge is detected, the solder bridge cannot be removed.

In order to solve the above problem, for example, there is disclosed Japanese Patent Application Laid-Open (JP-A) No. 2001-110491. In JP-A No. 2001-110491, a center position in a width direction of a portion exposed outward from the connector housing, of the upper-level terminal, is displaced by a predetermined amount (for example, a quarter of an array pitch) in one way of the width direction from the center position in the width direction of a female-terminal fitting portion of the upper-level terminal; the center position in the width direction of a portion exposed outward from the connector housing, of the lower-level terminal, is displaced by a predetermined amount (for example, a quarter of the array pitch) in the other way of the width direction from the center position in the width direction of a female-terminal fitting portion of the lower-level terminal; whereby the front-end portion of the lower-level terminal and the front-end portion of the upper-level terminal are alternately arrayed in a line.

However, in JP-A No. 2001-110491, it is necessary that a lower-level terminal dedicated part is used for the lower-level terminal and an upper-level terminal dedicated part is used for the upper-level terminal. Therefore, in order to produce these terminals, there is a problem that different dies are required for the lower-level terminal and the upper-level terminal, respectively.

SUMMARY OF THE INVENTION

In view of the foregoing, an object of the present invention is to provide a method of manufacturing a terminal, in which a common material can be used for each terminal at a stage of manufacturing a terminal device including a first terminal mounted in an upper-level mounting hole of a connector housing and a second terminal mounted in a lower-level mounting hole.

In a first aspect of the invention, there is provided a method of manufacturing a terminal, the terminal including a connector housing mounted on a board, a first terminal, and a second terminal, the first terminal being mounted in an upper mounting hole of two-level mounting holes, the second terminal being mounted in a lower mounting hole of the two-level mounting holes, the two-level mounting holes being made in the connector housing, the first terminal having a first terminal portion engaged in the upper mounting hole and a first leg portion extending integrally from the first terminal portion, a center position in a width direction of the first leg portion being displaced from the center position in the width direction of the first terminal portion, the first leg portion being bent toward the board, a front-end portion of the first leg portion is mounted on the board, the second terminal having a second terminal portion engaged in the lower mounting hole and a second leg portion extending integrally from the second terminal portion, the center position in the width direction of the second leg portion being displaced from the center position in the width direction of the second terminal portion toward the opposite side of the first leg portion, the second leg portion being bent toward the board, a front-end portion of the second leg portion is mounted on the board, the terminal manufacturing method comprising the steps of: forming a thin plate-like body constituted of a thin plate-like terminal portion and a thin plate-like leg portion, the thin plate-like terminal portion having a shape corresponding to the first terminal portion of the first terminal and the second terminal portion of the second terminal, the thin plate-like leg portion having the shape corresponding to the first leg portion of the first terminal and the second leg portion of the second terminal; forming the first terminal by bending the thin plate-like leg portion of one thin plate-like body toward one side of a plate-thickness direction; and forming the second terminal by bending the thin plate-like leg portion of another thin plate-like body toward the other side of the plate-thickness direction.

According to the first aspect of the invention, the thin plate-like body including the thin plate-like terminal portion and the thin plate-like leg portion is formed. The thin plate-like terminal portion has the shape corresponding to the first terminal portion of the first terminal and the second terminal portion of the second terminal, and the thin plate-like leg portion has the shape corresponding to the first leg portion of the first terminal and the second leg portion of the second terminal.

Then, the thin plate-like leg portion of one thin plate-like body is bent toward one side in the plate-thickness direction, whereby the first terminal is formed which is constituted of the first terminal portion as the thin plate-like terminal portion and the first leg portion as the bent thin plate-like leg portion.

On the other hand, the thin plate-like leg portion of another thin plate-like body is bent toward the other side in the plate-thickness direction, whereby the second terminal is formed which is constituted of the second terminal portion as the thin plate-like terminal portion and the second leg portion as the bent thin plate-like leg portion.

Namely, according to the terminal manufacturing method of the first aspect of the invention, by changing the bending direction of the thin plate-like leg portion of the thin plate-like body as the material, either the first terminal or the second terminal can be formed.

In manufacturing the first terminal and the second terminal, the terminals can share the same blank material (thin plate-like body), so that the same die for forming the thin plate-like body can commonly be used for both of the first and the second terminals. Accordingly, the die cost can be reduced.

In a second aspect of the invention, the terminal manufacturing method further comprising the steps of: forming the thin plate-like body such that the center position in the plate-thickness direction of the thin plate-like leg portion of the thin plate-like body is aligned with the center position in the plate-thickness direction of the thin plate-like terminal portion of the thin plate-like body; making the center position in the plate-thickness direction of the first leg portion of the first terminal be aligned with the center position in the plate-thickness direction of the first terminal portion of the first terminal; and making the center position in the plate-thickness direction of the second leg portion of the second terminal be aligned with the center position in the plate-thickness direction of the second terminal portion of the second terminal.

According to the second aspect of the invention, in the thin plate-like leg portion of the thin plate-like body, the shape in the plate-thickness direction thereof is formed so as to be symmetrical with respect to the center position in the plate-thickness direction of the thin plate-like terminal portion. Therefore, both in bending the thin plate-like leg portion of the thin plate-like body toward one side of the plate-thickness direction and in bending the thin plate-like leg portion toward the other side of the plate-thickness direction, the loads required for these bending works can be rendered to the same level.

Then, using the thin plate-like body as a material, the first terminal is manufactured such that the center position in the plate-thickness direction of the first leg portion thereof is aligned with the center position in the plate-thickness direction of the first terminal portion, and the second terminal is manufactured such that the center position in the plate-thickness direction of the second leg portion thereof is aligned with the center position in the plate-thickness direction of the second terminal portion.

As a result, according to the second aspect of the invention, product accuracy of the first terminal and the second terminal can be significantly improved, which is preferable.

As described above, in the terminal manufacturing method according to the invention, when the terminal includes the first terminal mounted in the upper-level mounting hole of the connector housing and the second terminal mounted in the lower-level mounting hole, these terminals can share a blank material of the same type at the manufacturing stage thereof.

DETAILED DESCRIPTION OF THE INVENTION

An upper-level terminal 22 as a first terminal and a lower-level terminal 28 as a second terminal will be described below with reference to FIGS. 1 to 3. The upper-level terminal 22 and the lower-level terminal 28 are applied to a surface-mount connector (SMT connector) 10 according to an embodiment of the invention. For the sake of convenience, in FIGS. 1A and 1B, the direction indicated by an arrow A is set at a front, the direction indicated by an arrow B orthogonal to the arrow A is set at a right side, and the direction indicated by an arrow C orthogonal to both the arrow A and the arrow B is set at an upper side.

Figure 1B:
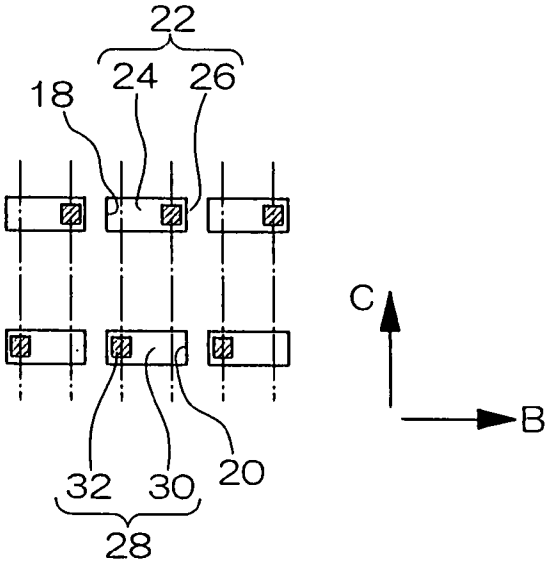
FIG. 1B is a rear view showing the upper-level terminal and the lower-level terminal of FIG. 1A.
Figure 1A:
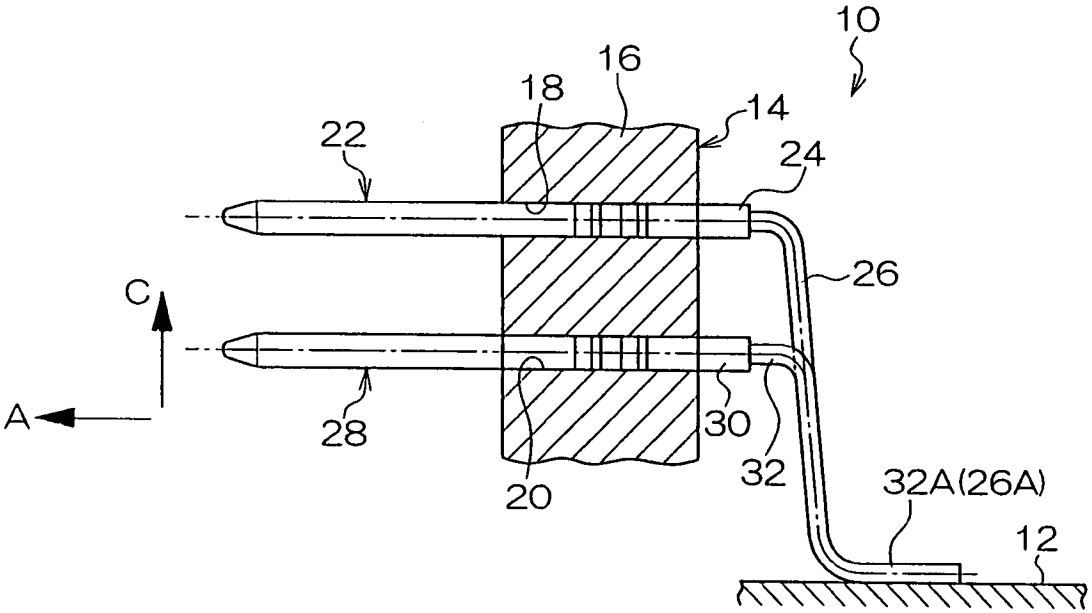
FIG. 1A is a sectional side view showing a state in which an upper-level terminal and a lower-level terminal of a surface-mount connector according to an embodiment of the present invention are mounted on aboard.

FIG. 1A is a sectional side view schematically showing the SMT connector 10 and a board (for example, a printed board in which lands are printed by screen printing and the like), where the SMT connector 10 is mounted.

The SMT connector 10 includes a connector main body 14 as the connector housing. The connector main body 14 is formed, e.g. in the substantially rectangle box. The connector main body 14 has a back wall 16 which is vertically provided with respect to the board 12 while mounted on the board 12. Plural upper-level terminal mounting holes 18 and plural lower-level terminal mounting holes 20 are formed in the back wall 16. The plural upper-level terminal mounting holes 18 are arranged in parallel along a horizontal direction, and the plural lower-level terminal mounting holes 20 are also arranged in parallel along a horizontal direction (see FIG. 1B).

As shown in FIGS. 1A and 1B, the upper-level terminal mounting holes 18 are formed right above the lower-level terminal mounting holes 20, respectively. The upper-level terminal mounting holes 18 and the lower-level terminal mounting holes 20 are formed so as to be symmetrical in both the vertical direction and the horizontal direction. Further, the upper-level terminal mounting holes 18 and the lower-level terminal mounting holes 20 are each formed to have a rectangular shape in which the dimension in the horizontal direction is larger than that in the vertical direction when viewed from the rear face (see FIG. 1B).

The SMT connector 10 also includes plural upper-level terminals 22 and plural lower-level terminals 28. The upper-level terminals 22 are arranged in parallel along the horizontal direction, and the lower-level terminals 28 are arranged in parallel along the horizontal direction. As shown in FIGS. 1A and 1B, the upper-level terminals 22 are arranged right above the lower-level terminals 28 respectively.

The upper-level terminal 22 is made of a metal material (i.e. conductor), and the upper-level terminal 22 includes a terminal portion 24 which is engaged in the upper-level terminal mounting holes 18 formed in the back wall 16 of the connector main body 14. The terminal portion 24 is formed as a thin plate-like body whose longitudinal direction is set back and forth. The terminal portion 24 is formed to be symmetrical both in the vertical direction and the horizontal direction. Further, the terminal portion 24 is formed to have an elongated shape in which the dimension in the horizontal direction is larger than that in the vertical direction when viewed from the rear face (see FIG. 1B).

A leg portion 26 is integrally formed on the rear side of the terminal portion 24. The leg portion 26 is formed continuous with the terminal portion 24 such that the center position in the width direction of the leg portion 26 is displaced rightward from the center position in the width direction of the terminal portion 24, i.e. the leg portion 26 is offset rightward with respect to the terminal portion 24. Further, the leg portion 26 is formed continuous with the terminal portion 24 such that the center position in a plate-thickness direction of the leg portion 26 is aligned with the center position in the plate-thickness direction of the terminal portion 24.

The leg portion 26 is bent downward (toward the board 12 side) midway, and a front-end portion 26A is bent along the upper surface of the board 12. The front-end portion 26A is mounted onto the board 12 by the soldering.

The lower-level terminal 28 is made of a metal material (i.e. conductor), and the lower-level terminal 28 includes a terminal portion 30 which is engaged in the lower-level terminal mounting holes 20 formed in the back wall 16 of the connector main body 14. The terminal portion 30 is formed as a thin plate-like body whose longitudinal direction is set back and forth. The terminal portion 30 is formed to be symmetrical both in the vertical direction and the horizontal direction. Further, the terminal portion 30 is formed to have an elongated shape in which the dimension in the horizontal direction is larger than that in the vertical direction when viewed from the rear face.

A leg portion 32 is integrally formed on the rear side of the terminal portion 30. The leg portion 32 is formed continuous with the terminal portion 30 such that the center position in the width direction of the leg portion 32 is displaced leftward from the center position in the width direction of the terminal portion 30, i.e. the leg portion 32 is offset leftward with respect to the terminal portion 30. Further, the leg portion 32 is formed continuous with the terminal portion 30 such that the center position in the plate-thickness direction of the leg portion 32 is aligned with the center position in the plate-thickness direction of the terminal portion 30.

The leg portion 32 is bent downward (toward the board 12 side) midway, and a front-end portion 32A is bent along the upper surface of the board 12. The front-end portion 32A is mounted onto the board 12 by the soldering.

In the state in which the front-end portion 26A of the leg portion 26 and the front-end portion 32A of the leg portion 32 are mounted on the board 12, the front-end portion 26A of the leg portion 26 and the front-end portion 32A of the leg portion 32 are arranged in a line in the horizontal direction, while the front-end portion 26A and front-end portion 32A sit alternately with intervals therebetween.

Namely, the upper-level terminal 22 and the lower-level terminal 28 are mounted on the board 12 while piercing through the back wall 16 to project backward of the connector main body 14 respectively. Thus, the SMT connector 10 is formed in the male connector, and the SMT connector 10 is configured to be connected to the female connector which is of an external terminal. In the connection state, the upper-level terminal 22 and the lower-level terminal 28 as the male terminals are connected to the external terminal in the electrically conductive state by inserting the upper-level terminal 22 and the lower-level terminal 28 into the female terminal provided in the external terminal.

The action of the embodiment of the invention will be described.

Figure 2:
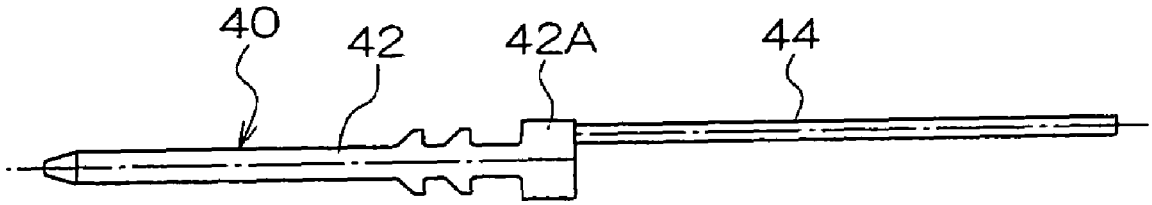
FIG. 2 is a plan view schematically showing a thin plate-like body according to the embodiment of the invention.

As shown in FIG. 2, a thin plate-like body 40 including a thin plate-like terminal portion 42 and a thin plate-like leg portion 44 is formed with the die. The thin plate-like terminal portion 42 formed in an elongated shape corresponds to the terminal portion 24 of the upper-level terminal 22 and the terminal portion 30 of the lower-level terminal 28. The thin plate-like leg portion 44 corresponds to the leg portion 26 of the upper-level terminal 22 or the leg portion 32 of the lower-level terminal 28.

In the thin plate-like leg portion 44 of the thin plate-like body 40, the center position in the width direction (direction corresponding to the horizontal directions of the upper-level terminal 22 and the lower-level terminal 28) of the thin plate-like leg portion 44 is displaced from the center position in the width direction of the thin plate-like terminal portion 42. Further, the thin plate-like leg portion 44 is formed so as to extend linearly along the longitudinal direction of the thin plate-like terminal portion 42.

In this case, the thin plate-like leg portion 44 is formed such that the center position in the plate-thickness direction of the thin plate-like leg portion 44 is aligned with the center position in the plate-thickness direction of the thin plate-like terminal portion 42. As a result, the shape in the plate-thickness direction of the thin plate-like leg portion 44 is made symmetrical with respect to the center position in the plate-thickness direction of the thin plate-like terminal portion 42. Therefore, both in bending the thin plate-like leg portion 44 upward in the plate-thickness direction and in bending the thin plate-like leg portion 44 downward in the plate-thickness direction, the loads required for these the bending works can be rendered to the same level.

Figure 3:
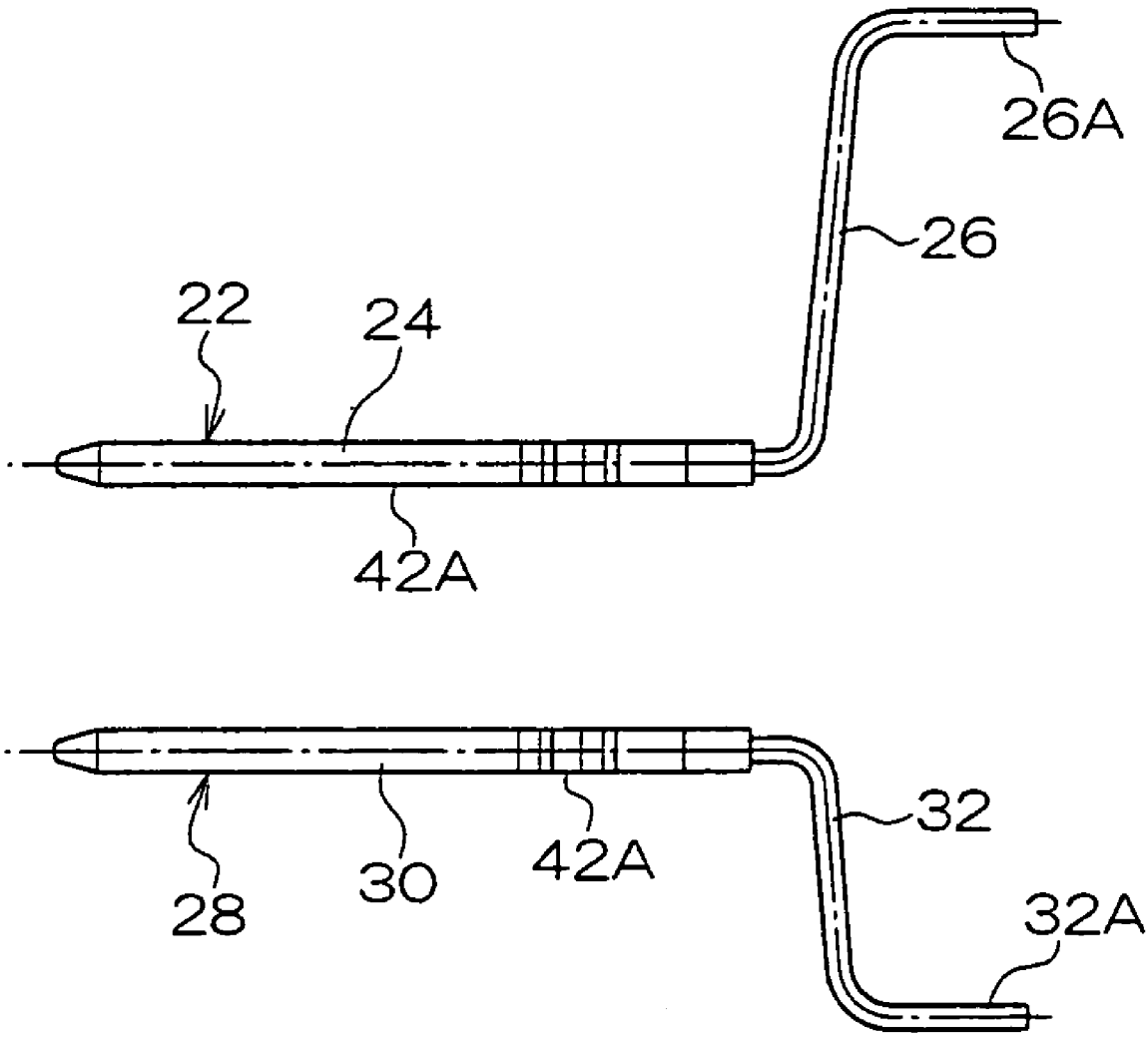
FIG. 3 is a plan view schematically showing the terminal in a process of forming the upper-level terminal and the lower-level terminal from the thin plate-like body according to the embodiment of the invention.

Then, as shown in FIG. 3, the thin plate-like leg portion 44 of one thin plate-like body 40 is bent upward in the plate-thickness direction (toward the opposite side of a lower surface 42A of the thin plate-like terminal portion 42 in the plate-thickness direction) midway in the extending direction, and the front-end portion of the leg portion is bent so as to extend in parallel to the longitudinal direction of the thin plate-like terminal portion 42 and away from the thin plate-like terminal portion 42, whereby the leg portion 26 is formed. The front-end portion of the leg portion 26 thus bend is denoted as the front-end portion 26A. The terminal portion 24 is thus manufactured from the thin plate-like terminal portion 42.

At this point, the thin plate-like leg portion 44 of the thin plate-like body 40 is bent such that the center position in the plate-thickness direction on the base end side, of the leg portion 26 (a boundary portion of the terminal portion 24), is aligned with the center position in the plate-thickness direction of the terminal portion 24. Namely, the shape on the base end side, of the leg portion 26, is formed to be symmetrical with respect to the center position in the plate-thickness direction of the terminal portion 24.

Accordingly, the thin plate-like body 40 is formed in the upper-level terminal 22 as a whole.

On the other hand, the thin plate-like leg portion 44 of another thin plate-like body 40 is bent downward in the plate-thickness direction (toward the lower surface 42A of the thin plate-like terminal portion 42 in the plate-thickness direction) midway in the extending direction, and the front-end portion at the leg portion is bent so as to extend in parallel to the longitudinal direction of the thin plate-like terminal portion 42 and away from the thin plate-like terminal portion 42, whereby the leg portion 32 is formed. The front-end portion of the leg portion 32 thus bent is denoted as the front-end portion 32A. The terminal portion 30 is thus manufactured from the thin plate-like terminal portion 42.

At this point, the thin plate-like leg portion 44 of the thin plate-like body 40 is bent such that the center position in the plate-thickness direction on the base end side of the leg portion 32 (a boundary portion of the terminal portion 30) is aligned with the center position in the plate-thickness direction of the terminal portion 30. Namely, the shape on the base end side, of the leg portion 32, is formed to be symmetrical with respect to the center position in the plate-thickness direction of the terminal portion 30.

Accordingly, the thin plate-like body 40 is formed in the upper-level terminal 28 as a whole.

Thus, in manufacturing the upper-level terminal 22 and the lower-level terminal 28, the shape on the base end side, of the leg portion 26, is made symmetrical with respect to the center position in the plate-thickness direction of the terminal portion 24, and the shape on the base end side, of the leg portion 32, is made symmetrical with respect to the center position in the plate-thickness direction of the terminal portion 30. As a result, the product accuracy of the upper-level terminal 22 and the lower-level terminal 28 can be improved.

As described above, either the upper-level terminal 22 or the lower-level terminal 28 can be formed by simply changing the bending direction of the thin plate-like leg portion 44 of the thin plate-like body 40, which is a blank material used in common between these two types of terminals.

That is, in manufacturing the upper-level terminal 22 and the lower-level terminal 28, these terminals can share a blank the material of the same type (thin plate-like body 40), so that the die for forming the thin plate-like body 40 can be used in common. As a result, the die cost can be reduced.

In the embodiment, the thin plate-like body 40 is produced with a die. However, the invention is not limited to the embodiment. For example, the thin plate-like body 40 may be produced by machining one flat plate.

In the embodiment, the thin plate-like body 40 is formed such that the center position in the plate-thickness direction of the thin plate-like leg portion 44 of the thin plate-like body 40 is aligned with the center position in the plate-thickness direction of the thin plate-like terminal portion 42 of the thin plate-like body 40. However, it is also possible that the thin plate-like body 40 is formed such that the center position of the thin plate-like leg portion 44 is not aligned with the center position of the thin plate-like terminal portion 42.

What is claimed is:

1. A method of manufacturing a terminal, the terminal including a connector housing mounted on a board, a first terminal and a second terminal, the first terminal being mounted in an upper mounting hole of two-level mounting holes, the second terminal being mounted in a lower mounting hole of the two-level mounting holes, the two-level mounting holes being made in the connector housing, the first terminal having a first terminal portion engaged in the upper mounting hole and a first leg portion extending integrally from the first terminal portion, a center position in a width direction of the first leg portion being displaced from the center position in the width direction of the first terminal portion, the first leg portion being bent toward the board, a front-end portion of the first leg portion is mounted on the board, the second terminal having a second terminal portion engaged in the lower mounting hole and a second leg portion extending integrally from the second terminal portion, the center position in the width direction of the second leg portion being displaced from the center position in the width direction of the second terminal portion toward the opposite side of the first leg portion, the second leg portion being bent toward the board, a front-end portion of the second leg portion is mounted on the board, the terminal manufacturing method comprising the steps of:

forming a thin plate-like body constituted of a thin plate-like terminal portion and a thin plate-like leg portion, the thin plate-like terminal portion having a shape corresponding to the first terminal portion of the first terminal and the second terminal portion of the second terminal, the thin plate-like leg portion having the shape corresponding to the first leg portion of the first terminal and the second leg portion of the second terminal;

forming the first terminal by bending the thin plate-like leg portion of one thin plate-like body toward one side of a plate-thickness direction; and forming the second terminal by bending the thin plate-like leg portion of another thin plate-like body toward the other side of the plate-thickness direction.

2. The method of manufacturing a terminal of claim 1, further comprising the steps of:

forming the thin plate-like body such that the center position in the plate-thickness direction of the thin plate-like leg portion of the thin plate-like body is aligned with the center position in the plate-thickness direction of the thin plate-like terminal portion of the thin plate-like body;

making the center position in the plate-thickness direction of the first leg portion of the first terminal be aligned with the center position in the plate-thickness direction of the first terminal portion of the first terminal; and making the center position in the plate-thickness direction of the second leg portion of the second terminal be aligned with the center position in the plate-thickness direction of the second terminal portion of the second terminal.

3. The method of manufacturing a terminal of claim 1, wherein the first terminal forming step further includes a step of, after bending the thin plate-like leg portion of one thin plate-like body toward one side of the plate-thickness direction, bending a front-end portion of the thin plate-like leg portion in parallel to a longitudinal direction of the thin plate-like terminal portion and away from the thin plate-like terminal portion.

4. The method of manufacturing a terminal of claim 3, wherein the step of bending the front-end portion of the thin plate-like leg portion of one thin plate-like body in parallel to the longitudinal direction of the thin plate-like terminal portion and away from the thin plate-like terminal portion further includes a step of bending the front-end portion such that the front-end portion lands on the board when one thin plate-like body is mounted in the upper mounting hole.

5. The method of manufacturing a terminal of claim 1, wherein the second terminal forming step further includes a step of, after bending the thin plate-like leg portion of another thin plate-like body toward the other side of the plate-thickness direction, bending the front-end portion of the thin plate-like leg portion in parallel to the longitudinal direction of the thin plate-like terminal portion and away from the thin plate-like terminal portion.

6. The method of manufacturing a terminal of claim 5, wherein the step of bending the front-end portion of the thin plate-like leg portion of another thin plate-like body in parallel to the longitudinal direction of the thin plate-like terminal portion and away from the thin plate-like terminal portion further includes a step of bending the front-end portion such that the front-end portion lands on the board when another thin plate-like body is mounted in the lower mounting hole.

7. The method of manufacturing a terminal of claim 1, wherein a shape obtained by rotating a sectional shape in the width direction of the first leg portion by 180° coincides with a sectional shape in the width direction of the second leg portion.

8. The method of manufacturing a terminal of claim 7, wherein the step of forming the first terminal/the second terminal further includes the steps of: rotating one thin plate-like body/another thin plate-like body by 180° about an axis in the longitudinal direction; and mounting the one thin plate-like body/the another thin plate-like body in the upper mounting hole/the lower mounting hole.

9. The method of manufacturing a terminal of claim 1, further comprising a step of forming the thin plate-like body with a die.

10. The method of manufacturing a terminal of claim 1, further comprising a step of forming the thin plate-like body by machining.

11. A method of manufacturing a terminal, the terminal including a connector housing mounted on a board, a first terminal and a second terminal, the first terminal being mounted in an upper mounting hole of two-level mounting holes, the second terminal being mounted in a lower mounting hole of the two-level mounting holes, the two-level mounting holes being made in the connector housing, the first terminal having a first terminal portion engaged in the upper mounting hole and a first leg portion extending integrally from the first terminal portion, a center position in a width direction of the first leg portion being displaced from the center position in the width direction of the first terminal portion, the first leg portion being bent toward the board, a front-end portion of the first leg portion is mounted on the board, the second terminal having a second terminal portion engaged in the lower mounting hole and a second leg portion extending integrally from the second terminal portion, the center position in the width direction of the second leg portion being displaced from the center position in the width direction of the second terminal portion toward the opposite side of the first leg portion, the second leg portion being bent toward the board, a front-end portion of the second leg portion is mounted on the board, a shape obtained by rotating a sectional shape in the width direction of the first leg portion by 180° coinciding with a sectional shape in the width direction of the second leg portion, the terminal manufacturing method comprising the steps of:

forming a thin plate-like body constituted of a thin plate-like terminal portion and a thin plate-like leg portion, the thin plate-like terminal portion having a shape corresponding to the first terminal portion of the first terminal, the thin plate-like leg portion having the shape corresponding to the first leg portion of the first terminal;

forming the first terminal by bending the thin plate-like leg portion of one thin plate-like body toward one side of a plate-thickness direction; and forming the second terminal by bending the thin plate-like leg portion of another thin plate-like body toward the other side of the plate-thickness direction.

12. The method of manufacturing a terminal of claim 11, further comprising the steps of:

forming the thin plate-like body such that the center position in the plate-thickness direction of the thin plate-like leg portion of the thin plate-like body is aligned with the center position in the plate-thickness direction of the thin plate-like terminal portion of the thin plate-like body;

making the center position in the plate-thickness direction of the first leg portion of the first terminal be aligned with the center position in the plate-thickness direction of the first terminal portion of the first terminal; and making the center position in the plate-thickness direction of the second leg portion of the second terminal be aligned with the center position in the plate-thickness direction of the second terminal portion of the second terminal.

13. The method of manufacturing a terminal of claim 11, wherein the first terminal forming step further includes a step of, after bending the thin plate-like leg portion of one thin plate-like body toward one side of the plate-thickness direction, bending a front-end portion of the thin plate-like leg portion in parallel to a longitudinal direction of the thin plate-like terminal portion and away from the thin plate-like terminal portion.

14. The method of manufacturing a terminal of claim 13, wherein the step of bending the front-end portion of the thin plate-like leg portion of one thin plate-like body in parallel to the longitudinal direction of the thin plate-like terminal portion and away from the thin plate-like terminal portion further includes a step of bending the front-end portion such that the front-end portion lands on the board when one thin plate-like body is mounted in the upper mounting hole.

15. The method of manufacturing a terminal of claim 11, wherein the second terminal forming step further includes a step of, after bending the thin plate-like leg portion of another thin plate-like body toward the other side of the plate-thickness direction, bending the front-end portion of the thin plate-like leg portion in parallel to the longitudinal direction of the thin plate-like terminal portion and away from the thin plate-like terminal portion.

16. The method of manufacturing a terminal of claim 15, wherein the step of bending the front-end portion of the thin plate-like leg portion of another thin plate-like body in parallel to the longitudinal direction of the thin plate-like terminal portion and away from the thin plate-like terminal portion further includes a step of bending the front-end portion such that the front-end portion lands on the board when another thin plate-like body is mounted in the lower mounting hole.

17. The method of manufacturing a terminal of claim 11, wherein the step of forming the first terminal/the second terminal further includes the steps of: rotating one thin plate-like body/another thin plate-like body by 180° about an axis in the longitudinal direction; and mounting the one thin plate-like body/the another thin plate-like body in the upper mounting hole/the lower mounting hole.

18. The method of manufacturing a terminal of claim 11, further comprising a step of forming the thin plate-like body with a die.

19. The method of manufacturing a terminal of claim 11, further comprising a step of forming the thin plate-like body by machining.

* * * * *